United States Patent [19]

Northup

[11] 4,150,529

[45] Apr. 24, 1979

[54] METHOD OF MAKING ELASTIC YARN

[75] Inventor: Francis B. Northup, Sanford, N.C.

[73] Assignee: Hanes Corporation, Winston-Salem, N.C.

[21] Appl. No.: 896,282

[22] Filed: Apr. 14, 1978

[51] Int. Cl.[2] ..... D02G 3/32; D02G 3/38

[52] U.S. Cl. ..... 57/6; 57/18; 57/210

[58] Field of Search ..... 57/3, 6, 13, 17, 18, 57/163, 210

[56] References Cited

U.S. PATENT DOCUMENTS

| | | | |
|---|---|---|---|
| 2,061,021 | 11/1936 | Chittenden et al. | 57/12 |
| 2,263,614 | 11/1941 | Cote | 57/12 |
| 2,804,745 | 9/1957 | Foster | 57/225 |
| 3,009,311 | 11/1961 | Wang | 57/225 |
| 3,098,347 | 7/1963 | Smith | 57/225 |
| 3,124,924 | 3/1964 | Smith | 57/163 X |
| 3,391,532 | 7/1968 | Fitton | 57/12 |
| 3,668,857 | 6/1972 | Goy et al. | 57/18 X |
| 3,983,687 | 10/1976 | Lewis | 57/163 |

FOREIGN PATENT DOCUMENTS

| | | | |
|---|---|---|---|
| 1051081 | 3/1964 | United Kingdom | 57/18 |

*Primary Examiner*—Donald Watkins

*Attorney, Agent, or Firm*—Charles Y. Lackey; William S. Burden

[57] ABSTRACT

A balanced elastic yarn includes an elastomeric core twisted in one direction and a single cover strand helically wrapped about the elastic core in a direction opposite to the twist direction of the elastic core. After a predetermined twist has been inserted in the elastic core, the core is tensioned with the elongation being positively controlled between spaced points intermediate the yarn take up and the elastic core supply and a high number of wraps per inch of the cover strand are helically wound about the elongated core while the core draft or stretch is positively controlled. The elastic core take-up package is subjected to heat to relieve the stresses in the cover strand resulting in a balanced elastic yarn in the relax state.

8 Claims, 2 Drawing Figures

METHOD OF MAKING ELASTIC YARN

BACKGROUND, BRIEF SUMMARY AND OBJECTS OF THE INVENTION

This invention relates to a balanced, single cover elastic yarn and to a novel method of making the yarn. More particularly, the invention relates to a yarn in which an elastic core is helically wrapped with a thermoplastic strand, and stresses in the thermoplastic strand are relieved by heat application.

Elastic yarns usually consist of an elastic core about which is helically wrapped one or more strands of material. Normally, such elastic yarns are formed by directing an inelastic strand about an elastic core or filament resulting in a single cover elastic yarn, or by directing two equal inelastic strands about an elastic core in opposite directions resulting in a double covered yarn, which is normally balanced. The cover strand or strands are wrapped or directed about the elastic core when the core is stretched, thus maintaining the core under tension and preventing contraction of the core to its original size. The elastic core may or not have twist therein, and the cover strand or strands may have twist therein prior to the being helically wrapped about the core, or the cover material may be relatively untwisted before being wrapped about the core. The core or elastic filament may be spandex, rubber or the like while the cover strands may be of various natural or synthetic textile fibers or filaments, particularly themoplastic materials.

Single cover, balanced elastic yarns are well known, as taught by U.S. Pat. Nos. 2,061,021; 2,804,745; 3,098,347; and 2,690,047.

Single cover elastic yarns generally are not used in the leg portions of pantyhose garments due to poor and inadequate cover of the elastic core because of the low number of wraps per inch of the cover strand upon the core. Also, merely increasing the number of wraps per inch further restricts the stretch characteristics of the elastic core. Further, increasing the number of wraps per inch of the cover strand is not satisfactory since the resultant elastic yarn is more torque lively and difficult to knit. Because of this tendency to kink or curl, such elastic yarns are difficult to control during knitting and fabric produced is inferior in quality.

In the processing of elastic yarns, particularly knitting of hosiery goods, the yarns must present a good appearance, have satisfactory stretch characteristics, and be free of any tendency to twist or kink during knitting.

Generally, man made yarns sold today have little or no twist therein, that is, a twist of 0.5 to 2.5 turns per inch. In the past, balanced single cover elastic yarns have been produced by various means. In U.S. Pat. No. 2,804,745, a core is pretwisted in one direction and a cover wrapped about the core in the opposite direction such that the cover and core counter-balance. As disclosed in U.S. Pat. No. 3,098,347, both the cover and core are pretwisted and both twists are removed as the cover is wrapped about the core. U.S. Pat. No. 2,061,021 discloses wrapping a cover yarn about an untwisted core to produce an unbalanced elastic yarn. In order to balance the elastic yarn, the elastic yarn is withdrawn from the driven package removing some spiral wraps from the cover and at the same time imparting a reverse twist to the core.

In many prior processes, it was necessary to pre-twist the elastic core to a very great extent to obtain a balanced yarn. However, pre-twisting of the core is costly and the degree of stretch is limited as the pre-twist of the core increases, thus restricting the ultimate extensibility of the final elastic yarn.

In accordance with the present invention, a twist is applied to the elastic core as it is removed from a supply source and the elongation or draft of the core is positively controlled within a zone intermediate the supply and a yarn take-up apparatus. The inelastic cover is helically wrapped about the core while the core is in a controlled, extended condition. The elastic yarn is permitted to relax or at least partially contract and is wound upon the take-up apparatus in a somewhat balanced state. The resultant yarn then is subjected to heat to relax or relieve the stresses in the cover strand to balance the yarn in the relaxed state.

One of the primary objects of the invention is the provision of a new and improved method for producing single cover elastic yarn balanced in the relaxed state.

Another object of the invention is the provision of a method for producing a more uniform single cover elastic yarn having a more complete coverage of the core.

Still another object of the invention is the provision of a system for producing a single cover elastic yarn which is balanced and torque free in the relaxed condition.

A further object of the invention is the method of producing an uniform, well-covered core having a greater range of elongation with a given number of wraps per inch of the single cover yarn.

Other objects and advantages of the invention will become apparent when considered in view of the following detailed description.

DETAILED DESCRIPTION OF THE INVENTION

Figure 1:
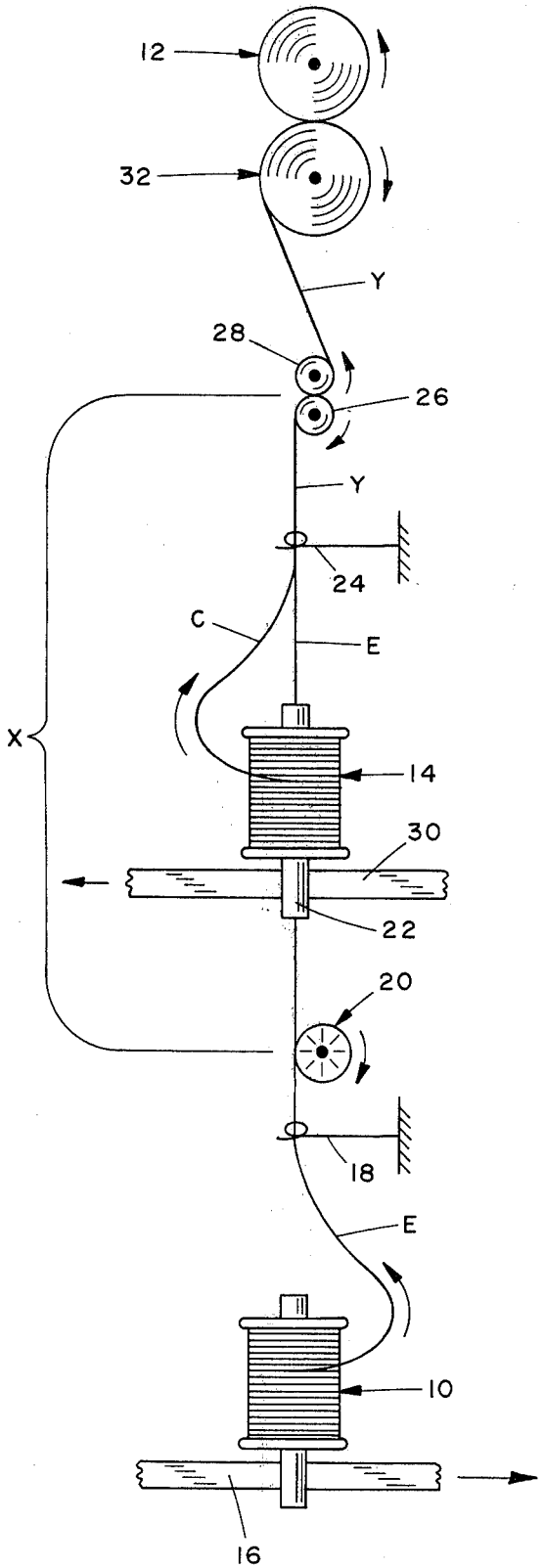
FIG. 1 illustrates schematically apparatus that can be used in carrying out the present invention.

In accordance with the principles of the present invention, an elastic core E is supplied from a spool 10 and has a cover strand C wrapped thereabout in a stretch or draft zone X before being wound upon take-up roll or package 12. The elastic core E may be any suitable elastic thread or filamentary material formed of rubber, spandex or the like having desired stretch, strength, durability and other required characteristics.

The inelastic cover thread or strand C is supplied from a spool 14 and is helically wrapped about the core E in the draft zone X.

While the cover may be of various materials or blends of materials, preferably the cover strand is of thermoplastic, continuous, multi-filamentary form.

The elastic core E upon the spool 10 is untwisted, as it is received from a producer. To apply a twist in a first direction to the elastic core E, the spool 10 is positively driven by belt 16 and the core twists about its own axis as it is drawn upwardly over the end of the spool 10. The twisted core E is directed through a guide 18 and around a star wheel 20 before advancing axially through the tubular spindle 22 of spool 14, guide 24, and between nip rolls 26, 28 before reaching the take-up roll 12.

The star wheel 20 and the nip rolls 26, 28 are positively driven to positively and accurately control the degree of elongation or draft applied to the twisted elastic core E independent of the cover C. The star wheel 20 and the rolls 26, 28 are driven at variable, selected speeds by independently controlled power means, not shown. The desired tension or elongation upon the core E is maintained by directing the elastic core E between the nip rolls 26, 28 at a selected higher rate than the rate at which the core is advanced by the star wheel 20. Therefore, the core E stretch or draft is uniformly constant and exact since it is accurately controlled within the zone X which is spaced intermediate and unaffected by the rotating core supply roll 10 and/or take up roll 12. The uniformity of the core elongation within intermediate zone X substantially eliminates variables in the elastic core elongation thus resulting in a uniform control over the core stretch characteristics. A certain amount of elongation is imparted by the air resistance as the core unwinds from the supply spool. Without star wheel 20, the elongation would be solely a function of spindle speed hence severely limiting the range of stretch of the covered yarn. Therefore, the r.p.m. of the core supply spindle can be selected to achieve a balanced cover yarn while at the same time the desired or selected elongation of the covered yarn can be achieved by means of the star wheel 20. It is to be understood that suitable means, other than star wheel 20 and nip rolls 26, 28, may be provided for accurately controlling the core elongation in the zone X.

The cover strand C is withdrawn upwardly over the end of spool 14, which is driven at a desired, selective speed by belt 30 and helically wrapped about the elastic core E which passes axially through the spool 14. The cover C is wrapped helically about the core E when the core is within draft zone X.

Figure 2:
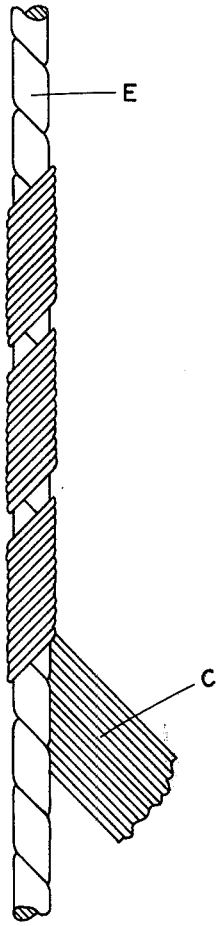
FIG. 2 illustrates an elastic yarn produced in accordance with the present invention with the yarn being partially extended.

The cover strand C on spool 14 has negligible twist, that is a small twist of 0.5 to 2.5 turns per inch inserted while producing the yarn. As the cover C is withdrawn from the spool 14, it is not twisted about its own axis but it is wrapped about the core E, due to the rotation of the driven spool 14, in a direction opposite to the axial twist of the elastic core E, as shown by FIG. 2. While the helical winding of the cover C in one direction tends to balance the twist of the core E in the opposite direction, the elastic yarn at this point is not completely balanced.

The take-up roll 12 is rotated by a friction drive roll 32 which is driven by a controlled, variable speed power means, now shown. After the composite core and cover Y emerge from the nip rolls 26, 28, the tension in the core E is at least partially relaxed permitting partial retraction of the elastic core E due to the surface speed differential between the nip rolls and the drive drum 32. The speed of rotation of the independently controlled nip rolls and the drive drum must be correlated in such a manner to wind the elastic yarn Y upon the take-up roll 12 with a desired controlled tension or substantially slack with no tension, as desired.

Processing elastic yarn by the above system results in a more uniform yarn due to a more consistent elongation since the core E is positively advanced independently of the cover. Since the speeds of the core and the cover may be varied, there is a greater control over the stretch characteristics and the final yarn Y results in a more completely and uniformly covered core. Since the zone X is positively controlled at both ends (by star wheel 20 and nip rolls 26, 28) and the draft is not dependent upon air drag, supply or take-up spindle speeds, etc., and the speeds of the star wheel and nip rolls are independently and selectively controlled, a greater range of elongation is possible with a given number of wraps per inch of the cover C. The revolutions per minute of the spools 10 and 14 are selectively controlled independent of each other and independent of the draft applied to the core in zone X resulting in a yarn which is more even and which has a wider range of elongation.

As previously indicated, the yarn Y wound upon the take-up spool 12 is not completely balanced and, therefore, is not suitable for knitting. The take-up package is subjected to atmospheric steam which relaxes and relieves stresses in the cover strand C and results in a smooth, torque free elastic yarn in the relaxed state. The application of steam must be sufficient to completely penetrate the take-up roll 12.

The following example is given to illustrate the aforedescribed invention.

A twist free 40 denier Lycra core is axially twisted in one direciton as it is drawn from supply spool 10 which is driven by bolt 16 at approximately 14,000 rpm. The twist free cover consists of a 20 denier 14 filament nylon strand supplied from spool 14 which is driven at approximately 21,000 rpm to wrap helically the 14 filaments about the core in a direction such that the filaments tend to balance the twist in the core. The speeds of the core through the draft zone and the elongation of the core in the draft zone are such that when the elastic yarn Y is in the generally relaxed state, the core E has approximately 46 wraps per inch of the cover strand C when extended. The finished yarn Y has an extensibility of 175% to 225%, and the core is more completely covered due to the high number of wraps. Heating the yarn Y with atmospheric steam does not shrink or set the cover strand but merely relieves the stresses in the nylon cover. The resultant single cover elastic yarn in the relaxed state is torque free, has an excellent covered, well protected core, and is easy to knit.

What is claimed is:

1. The method of forming a balanced, single cover, elastic yarn from an untwisted inelastic cover strand wound upon a first supply spool mounted upon a driven, tubular spindle, and an untwisted elastic core wound upon a supply spool mounted upon a driven spindle including the steps: positively rotating the elastic core supply spool at a first rate while removing the elastic core endwise from the supply spool to impart a predetermined twist in a first direction to the elastic core, advancing the twisted elastic core to a drafting zone at a first surface speed independent of the rate of rotation of the elastic core supply spool, tensioning and elongating the elastic core within the drafting zone by subsequently advancing the elastic core at a second surface speed greater than the first surface speed, and independent of the first surface speed and the rate of rotation of the core supply spool, withdrawing the inelastic cover strand from the driven first supply spool and wrapping helically the inelastic cover strand about the elastic core in the drafting zone and in a direction opposite to the twist in the elastic core while positively rotating the first supply spool at a rate independent of the rate of rotation of the elastic core supply spool and independent of the first and second surface speeds, at least partially relaxing the tension in the elastic core as the core emerges from the drafting zone, and winding the elastic yarn upon a spool.

2. The method as recited in claim 1, and further including the step of relieving stresses in the cover strand wrapped in a direction opposite to the direction of twist in the elastic core.

3. The method as recited in claim 2, wherein the stresses in the cover strand are relieved by subjecting the elastic yarn wound upon the spool to atmospheric steam.

4. The method of forming a balanced, single cover, elastic yarn from inelastic cover strand wound upon a first supply package mounted upon a driven, tubular spindle, and an elastic core wound upon a supply package mounted upon a driven spindle including the steps of: removing the elastic core endwise from the rotating supply package to impart a predetermined twist thereto in a first direction while advancing the elastic core from the supply package, through spaced first and second intermediate points to a collection point, regulating the elongation of the elastic core by applying a prescribed constant tension to the elastic core extending between the spaced intermediate points by positively controlling the surface velocities of the elastic core at the spaced intermediate points, advancing the inelastic cover strand endwise from the supply package and applying helical wrappings of the inelastic covering strand about the core in a direction opposite the twist in the elastic core while the elastic core is in the elongated state between the intermediate first and second points, and winding the covered elastic core into a package at the collection point at a surface velocity less than the surface velocity of the yarn at the second intermediate point.

5. The method as recited in claim 4, and further including the step of relieving the stresses in the inelastic cover strand wrapped upon the elastic core by subjecting the helical inelastic strand to atmospheric steam.

6. The method of making a balanced, single cover elastic yarn from an inelastic cover strand wound upon a first spool mounted upon a driven, tubular spindle, and an elastic core wound upon a second spool mounted upon a driven spindle including the steps of: positively rotating the elastic core spool at a selected rate, positively advancing the elastic core endwise of the spool to a drafting zone while applying a predetermined twist to the core in a first direction, positively controlling the elastic core in the drafting zone to maintain a constant tension and even elongation, positively rotating the inelastic cover spool at a selected rate while directing the inelastic cover strand endwise of the spool to helically wrap the cover around the core in the drafting zone in a direction opposite to the twist applied to the elastic core, positively advancing the single cover elastic yarn from the drafting zone, at least partially relieving the tension in the elastic core as the core and cover emerge from the drafting zone, and collecting the elastic yarn upon a take-up package.

7. The method as recited in claim 6, and further including the step of subjecting the elastic yarn wound upon the take-up package to a controlled heat to relax the stresses in the cover strands.

8. The method of forming a balanced, single cover elastic yarn comprising the steps of: advancing an elastic core which is untwisted upon a supply package, through spaced first and second intermediate points to a wind-up station, positively controlling elongation of the elastic core between the spaced first and second intermediate points by regulating the surface velocities of the elastic core at the spaced intermediate points, applying helical wrappings of a cover strand about the elongated elastic core intermediate the spaced points, and subjecting the elastic yarn to heat sufficiently to relieve stresses and relax the inelastic strand upon the elastic core to balance the yarn, wherein twist is applied to the elastic core as it is advanced from the supply and the inelastic cover strand is wrapped helically about the elastic core in a direction opposite to the direction of twist in the elastic core, resulting in a torque-free elastic yarn in the relaxed condition.

* * * * *